US009520095B2

(12) United States Patent
Wang

(10) Patent No.: US 9,520,095 B2
(45) Date of Patent: Dec. 13, 2016

(54) DISPLAY DRIVING CIRCUIT, DRIVING METHOD THEREOF AND DISPLAY APPARATUS

(71) Applicants: BOE Technology Group Co., Ltd., Beijing (CN); Beijing BOE Display Technology Co., Ltd., Beijing (CN)

(72) Inventor: Jieqiong Wang, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 0 days.

(21) Appl. No.: 14/743,168

(22) Filed: Jun. 18, 2015

(65) Prior Publication Data

US 2016/0240153 A1 Aug. 18, 2016

(30) Foreign Application Priority Data

Feb. 15, 2015 (CN) ..... 2015 1 0082684

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01); *G09G 2310/08* (2013.01); *G09G 2330/021* (2013.01)

(58) Field of Classification Search
None
See application file for complete search history.

(56) References Cited

U.S. PATENT DOCUMENTS 8,766,961 B2 * 7/2014 Huang ..... G09G 3/3614 345/209
2006/0238552 A1 * 10/2006 Chuang ..... G09G 5/006 345/690
2009/0174639 A1 7/2009 Chung et al.
2015/0145842 A1 * 5/2015 Maeda ..... G09G 3/3233 345/208

FOREIGN PATENT DOCUMENTS

CN 1773593 A 5/2006
CN 1917003 A 2/2007

OTHER PUBLICATIONS

First Office Action, including Search Report, for Chinese Patent Application No. 201510082684.9, dated May 30, 2016, 9 pages.

* cited by examiner

*Primary Examiner* — Seokyun Moon
(74) *Attorney, Agent, or Firm* — Westman, Champlin & Koehler, P.A.

(57) ABSTRACT

The present disclosure provides a display driving circuit, a driving method thereof, and a display apparatus, to solve the issue regarding power consumption of the display driver due to multiple reversal of the data voltage. The driving method comprises: firstly, determining pre-input data signals that are respectively input by a data line to each pixel unit of a column of pixel units corresponding to the data line when inputting a Nth image frame; next, determining, according to magnitudes or polarities of the pre-input data signals, a scanning order for the gate lines; then, scanning the gate lines according to the scanning order; and then, inputting the pre-input data signals to corresponding pixel units by the data lines.

12 Claims, 5 Drawing Sheets

DISPLAY DRIVING CIRCUIT, DRIVING METHOD THEREOF AND DISPLAY APPARATUS

CROSS-REFERENCE TO RELATED APPLICATION

This Application is a non-provisional Application of Chinese Application No. CN 201510082684.9, filed Feb. 15, 2015, in Chinese, the contents of which are hereby incorporated by reference in their entirety.

TECHNICAL FIELD

The present disclosure relates to the display technology field, and particularly to a display driving circuit, a driving method thereof, and a display apparatus.

BACKGROUND

As a specific kind of planar display apparatus, TFT-LCD (Thin Film Transistor Liquid Crystal Display) is becoming more and more popular in high performance display industry, since it has got various advantages, such as small size, low power consumption, low manufacturing cost and no radiation.

A TFT-LCD comprises an array substrate, a liquid crystal layer and a colored-film substrate. First, voltage is applied to a pixel electrode on the array substrate and a common electrode on the array substrate (or the colored-film substrate) to generate electric field in the liquid crystal layer; then, transmissivity of the light passing through the liquid crystal layer is adjusted by adjusting magnitude of the electric field, so as to obtain an expected display image. However, when the electric field that is maintained in the same direction is applied to the liquid crystal layer for a long time, deterioration that is not recoverable will be caused in the liquid crystal layer. A data voltage Vdata that is input to a data line on the array substrate is required to be reversed with respect to the polarity of a common voltage Vcom that is applied to the common electrode periodically.

Currently, common driving manners for the above polarity reversal include row reversal and point reversal. Particularly, row reversal is shown in FIG. 1*a*, where pixel units 100 in a same row have identical polarity of data voltage Vdata, whereas pixel units 100 in adjacent rows have opposite polarities of data voltage Vdata. When turning from the frame N to frame N+1, the reversal number of the data voltage Vdata is counted by one. Point reversal is shown in FIG. 1*b*, where every pixel unit 100 has a different polarity of data voltage Vdata than that of each of its adjacent pixel units 100.

However, in the prior art, for pixel units 100 in a same column, no matter which manner, i.e. row reversal or point reversal, is adopted, any two pixel units 100 of two adjacent rows have different polarities, therefore, the direction of the data voltage Vdata needs to be changed frequently. For example, for a display panel constituted of M rows, N columns of pixel units 100, the data voltage Vdata has to be substantially changed for M−1 times, which will significantly increase power consumption of the display driver and thus degrade the display's performance.

SUMMARY

An embodiment of the present disclosure provides a display driving circuit, a driving method thereof, and a display apparatus, to solve the issue regarding power consumption of the display driver due to multiple reversals of the data voltage.

In order to achieve the above object, the embodiment of the present disclosure adopts the following technical solutions:

In one aspect of the present disclosure, a driving method for a display driving circuit is provided, wherein the method is used for driving the display panel for displaying, and the display panel comprises an array of pixel units formed by crossing a plurality of rows of gate lines and a plurality of columns of data lines, the method comprising:

determining pre-input data signals that are respectively input by a data line to each pixel unit of a column of pixel units corresponding to the data line when inputting a Nth image frame, wherein N≥1;

determining, according to magnitudes or polarities of the pre-input data signals, a scanning order for the gate lines, such that a signal difference between the pre-input data signals that are input to two pixel units of the column of pixel units on two gate lines consecutively driven in the scanning order is less than or equal to a preset threshold;

scanning the gate lines according to the scanning order, so as to open each row of pixel units according to the scanning order; and inputting the pre-input data signals to corresponding pixel units by the data lines to achieve an image display.

In another aspect of the present disclosure, a display driving circuit for driving a display panel for displaying is provided, wherein the display panel comprises an array of pixel units formed by crossing a plurality of rows of gate lines and a plurality of columns of data lines, the display driving circuit comprising:

a signal determining means for determining pre-input data signals that are respectively input by a data line to each pixel unit of a column of pixel units corresponding to the data line when inputting a Nth image frame, wherein N≥1;

a timing controller, which is connected to the signal determining means, for determining, according to magnitudes or polarities of the pre-input data signals, a scanning order for the gate lines, such that a signal difference between the pre-input data signals that are input to two pixel units of the column of pixel units on two gate lines consecutively driven in the scanning order is less than or equal to a preset threshold;

a gate driver, which is connected to the timing controller and the gate lines respectively, for scanning the gate lines according to the scanning order, so as to open each row of pixel units according to the scanning order; and a source driver, which is connected to the timing controller and the data lines respectively, for inputting the pre-input data signals to corresponding pixel units by the data lines to achieve an image display.

In a further aspect of the present disclosure, a display apparatus is provided, the display apparatus comprises the display driving circuit as above.

The present disclosure provides a display driving circuit, a driving method thereof, and a display apparatus. The driving method for a display driving circuit is used for driving the display panel for displaying. The display panel comprises an array of pixel units formed by crossing a plurality of rows of gate lines and a plurality of columns of data lines. The method comprises: firstly, determining pre-input data signals that are respectively input by a data line to each pixel unit of a column of pixel units corresponding to the data line when inputting a Nth image frame, such that variations of the pre-input data signals provided by a data line during input of a frame of a display image is obtained; next, determining, according to magnitudes or polarities of the pre-input data signals, a scanning order for the gate lines, such that a signal difference between the pre-input data signals that are input to two pixel units of the column of pixel units on two t gate lines consecutively driven in the scanning order, is less than or equal to a preset threshold; then, scanning the gate lines according to the above scanning order, so as to open each row of pixel units according to the scanning order; and finally, inputting the pre-input data signals to corresponding pixel units by the data lines to achieve an image display. Differences between data signals for two pixel units of a same column of pixel units corresponding to two gate lines consecutively driven in the scanning order may be reduced by changing the scanning order for the gate lines, and thus prevent the data signals (e.g. data voltages) input by the data lines from being greatly reversed. Therefore, the above driving method may reduce power consumption for the display driver and improve the display's performance.

BRIEF DESCRIPTION OF THE DRAWINGS

In order to illustrate technical solutions in the embodiments of the present disclosure or in the prior art more clearly, accompanying drawings needed to be used in the description of the embodiments or the related art will be described below in brief. Obviously, the accompanying drawings described below are merely some embodiments of the present disclosure. A person having ordinary skill in the art can further obtain other accompanying drawings according to these accompanying drawing without contributing any creative labor.

REFERENCE SIGNS

10—display panel; 100—pixel unit; 11—signal determining means; 12—timing controller; 13—gate driver; 15—source driver.

DETAILED DESCRIPTION OF THE PREFERRED EMBODIMENTS

The embodiments will be further detailed in the following with reference to the figures. It should be appreciated that the embodiments described below are not all possible embodiments of the disclosure. All other embodiments that can be obtained by those skilled in the art based on those disclosed herein without creative efforts belong to the scope of the present disclosure.

Figure 2A:
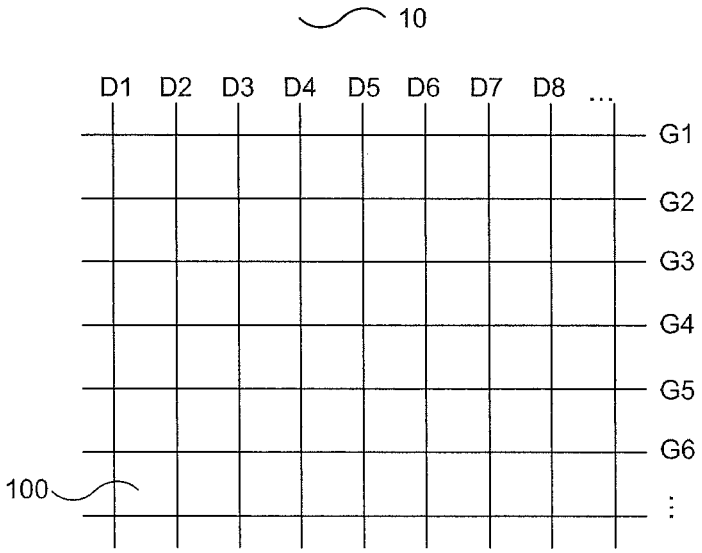
FIG. 2*a* is a structural diagram of a display panel according to an embodiment of the present disclosure.
Figure 2B:
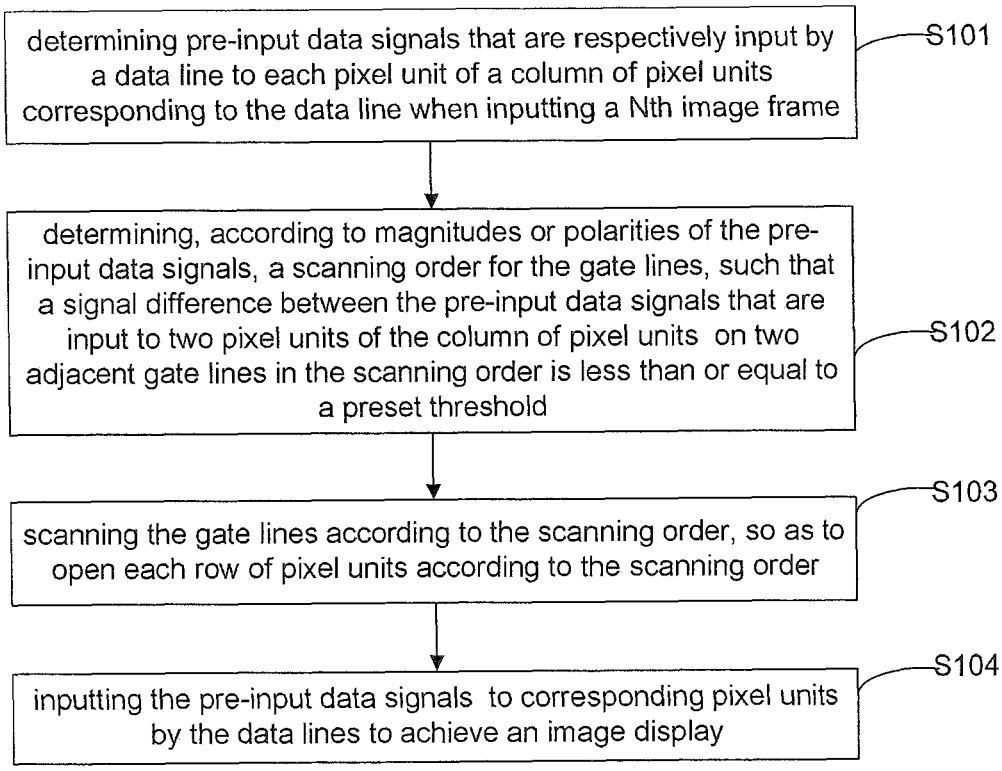
FIG. 2*b* is a flow chart of a display driving method according to an embodiment of the present disclosure.

The embodiments of the disclosure provide a driving method for a display driving circuit, the method is used for driving a display panel 10 for displaying. The display panel 10 is shown in FIG. 2*a*, the display panel 10 comprises an array of pixel units 100 formed by crossing a plurality of rows of gate lines (G1, G2, G3 . . . ) and a plurality of columns of data lines (D1, D2, D3 . . . ). As shown in FIG. 2*b*, the driving method comprises:

at S101, determining pre-input data signals P_Dm that are respectively input by a data line (e.g. D1) to each pixel unit of a column of pixel units 100 (e.g. pixel units that corresponds to the first data line D1) corresponding to the data line when inputting a Nth image frame, wherein N≥1.

at S102, determining, according to magnitudes or polarities of the pre-input data signals P_Dm, a scanning order for the gate lines (G1, G2, G3 . . . ), such that a signal difference between the pre-input data signals P_Dm that are input to two pixel units 100 of the column of pixel units 100 on two gate lines consecutively driven in the scanning order is less than or equal to a preset threshold.

at S103, scanning the gate lines according to the scanning order, so as to open each row of pixel units 100 according to the scanning order.

at S104, inputting the pre-input data signals P_Dm to corresponding pixel units 100 by the data lines (D1, D2, D3 . . . ) to achieve an image display.

It is noted that:

Firstly, the above pre-input data signals P_Dm may be pre-input data voltages Vdata, or pre-input grayscales (0~255). The disclosure does not limit this feature. However, since there are only 256 grayscales for the display image, several pre-input data voltages Vdata with small differences may correspond to a same grayscale. Therefore, when the above pre-input data signals P_Dm are the pre-input data voltages Vdata, greater accuracy may be achieved in comparison with the pre-input grayscale (0~255).

Secondly, those skilled in the art may set the above preset threshold according to actual production demand. The smaller the preset threshold is, the less the pre-input data signal P_Dm output by the data line is reversed, and thus the smaller the power consumption of the display driver is; on the contrary, the more the pre-input data signal P_Dm output by the data line is reversed, the larger the power consumption of the display driver is.

Specifically, when the above pre-input data signals P_Dm are the pre-input data voltages Vdata, the preset threshold is a voltage-difference threshold, which equals to 1V. Then, when executing step S102, a voltage difference between the pre-input data voltages Vdata that are input to two pixel units of the same column of pixel units on two gate lines consecutively driven in the scanning order may be made less than 1V, so as to significantly reduce the magnitude of reversal for the data voltages while inputting the data voltages by the data line, and thus reduce the power consumption of the display driver.

When the pre-input data signals P_Dm are the pre-input grayscales (0~255), the preset threshold is a grayscale-difference threshold, which equals to 10. Then, when executing step S102, a grayscale difference between the pre-input grayscales that are input to two pixel units of the column of pixel units on two gate lines consecutively driven in the scanning order may be made less than 10, so as to significantly reduce the magnitude of reversal for the grayscales while inputting the grayscales by the data line. However, grayscales may be converted into brightness values via Gamma curves (e.g. Gamma 2.2), and the brightness values are related to data voltages input by the data line, therefore by reducing the magnitude of reversal for the grayscales, the magnitude of reversing for the data voltages may also be reduced, and thus the power consumption of the display driver is reduced.

Figure 1A:
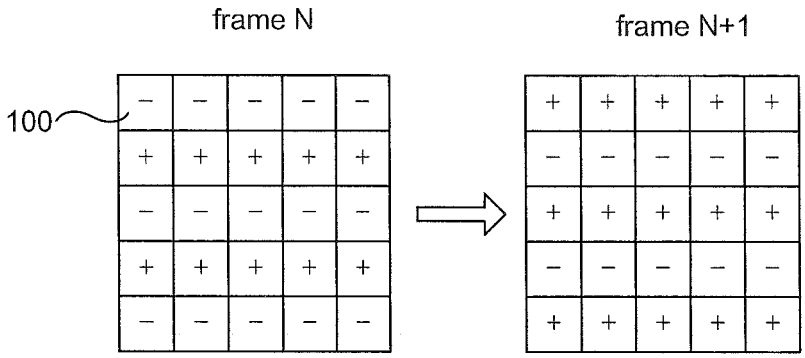
FIG. 1*a* is a schematic diagram of a row reversal driving manner as provided in the prior art.

Thirdly, the driving method provided in the disclosure is adapted to display panels adopting row reversal. In particular, as shown in FIG. 1*a*, the polarities of the pre-input data voltages Vdata for pixel units 100 in a same row are identical, for example, as shown in the figure on the left, the polarities for the first row of pixel units are all negative. Additionally, the polarities of the pre-input data voltages Vdata for pixel units 100 in adjacent rows are opposite, for example, as shown in the figure on the left, the polarities for the second row of pixel units 100 are all positive.

Figure 1B:
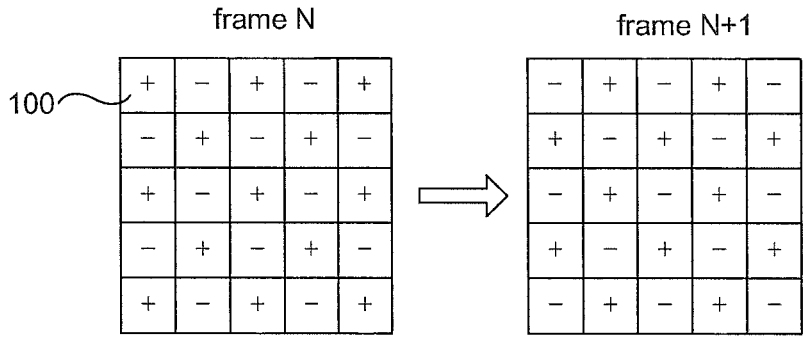
FIG. 1*b* is a schematic diagram of a point reversal driving manner as provided in the prior art.

Also, the driving method provided in the disclosure is adapted to display panels adopting point reversal. In particular, as shown in FIG. 1*b*, the polarity of the pre-input data voltage Vdata for each pixel unit 100 is opposite to those for the pixel units 100 which are adjacent to it, for example, as shown in the figure on the left, the polarity of the pre-input data voltage Vdata for the pixel unit 100 in the first row and the first column is positive, however, the polarities for those pixel units which are adjacent to it are negative, for example, the pixel unit 100 in the second row and the first column and the pixel unit 100 in the first row and the second column.

The present disclosure provides a driving method for a display driving circuit, used for driving the display panel for displaying. The display panel comprises an array of pixel units formed by crossing a plurality of rows of gate lines and a plurality of columns of data lines. The driving method comprises: firstly, determining pre-input data signals that are respectively input by a data line to each pixel unit of a column of pixel units corresponding to the data line when inputting a Nth image frame, such that variations of the pre-input data signals provided by a data line during input of a frame of a display image is obtained; next, determining, according to magnitudes or polarities of the pre-input data signals, a scanning order for the gate lines, such that a signal difference between the pre-input data signals that are input to two pixel units of the column of pixel units on two gate lines consecutively driven in the scanning order is less than or equal to a preset threshold; then, scanning the gate lines according to the above scanning order, so as to open each row of pixel units according to the scanning order; and finally, inputting the pre-input data signals to corresponding pixel units by the data lines to achieve an image display. Differences between data signals for two pixel units of a same column of pixel units on the two gate lines consecutively driven in the scanning order may be reduced by changing the scanning order for the gate lines, and thus prevent the data signals (e.g. data voltages) input by the data lines from being greatly reversed. Therefore, the above driving method may reduce power consumption for the display driver and improve the display's performance.

The driving method will be described in detail below by means of embodiments.

First Embodiment

Figure 3A:
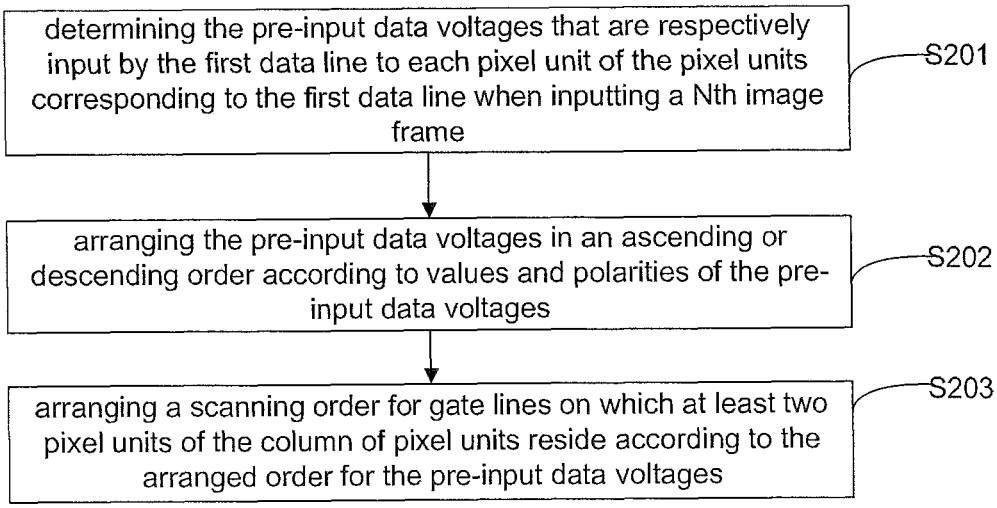
FIG. 3*a* is a flow chart of another display driving method according to an embodiment of the present disclosure.

When the above pre-input data signals P_Dm are pre-input data voltages Vdata, the magnitudes of the pre-input data signals P_Dm may be values and polarities of the data voltages Vdata. Additionally, on the condition that the preset threshold equals to 1V, the method for determining a scanning order for gate lines (G1, G2, G3) according to the values and polarities of the pre-input data voltages Vdata, as shown in FIG. 3, may comprises:

At S201, the pre-input data voltages Vdata that are respectively input by the first data line D1 to each of the pixel units corresponding to the first data line D1 are determined when inputting a Nth image frame.

Figure 3B:
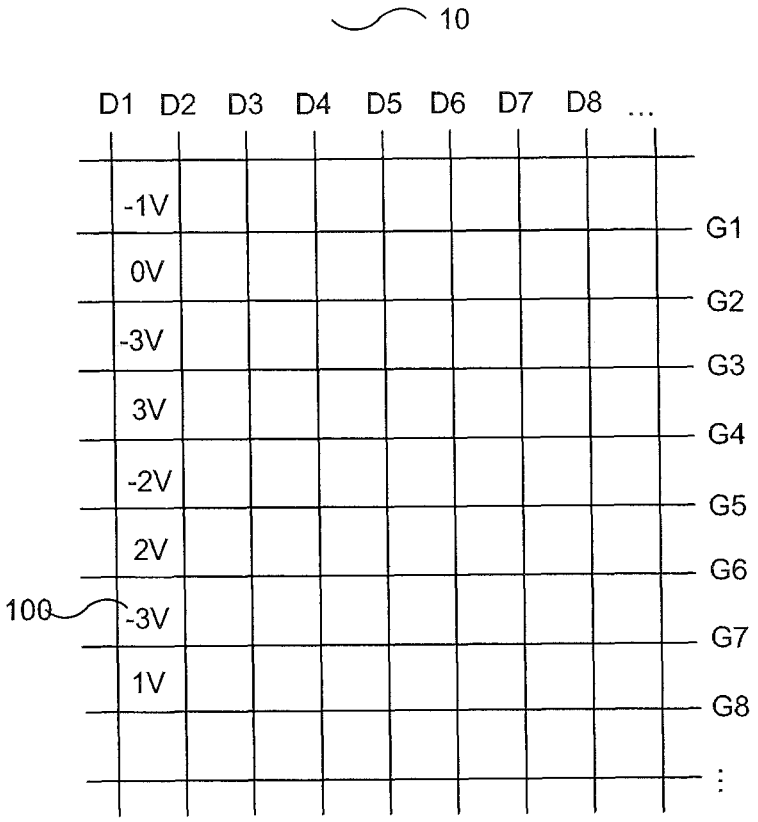
FIG. 3*b* is a diagram illustrating data signal input for a display panel according to an embodiment of the present disclosure.

In particular, for a color image, the grayscales for the pixel units 100 are not the same, therefore the data voltages input to the pixel units 100 are also not the same. As shown in FIG. 3*b*, the pre-input data voltages Vdata for the pixel units 100 corresponding to the first data line D1 are −1V, 0V, −3V, 3V, −2V, 2V, −3V, 1V respectively (voltages for other columns are not shown). From the these voltages, it can be seen that, while the gate lines (G1, G2, . . . , G8) are opened line by line, the pre-input data voltages Vdata will have to be greatly reversed for 7 times, especially the voltage is changed from −3V to 3V, and thereby increasing the power consumption for the display driver.

At S202, the pre-input data voltages Vdata are arranged in an ascending or descending order according to values and polarities of the pre-input data voltages Vdata.

For example, the above pre-input data voltages Vdata (−1V, 0V, −3V, 3V, −2V, 2V, −3V, 1V) are arranged in an ascending order according to the values and polarities, that is, −3V, −3V, −2V, −1V, 0V, 1V, 2V, 3V, wherein, the voltage difference between any two adjacent pre-input data voltages Vdata is less than or equal to 1V.

At S203, a scanning order for gate lines on which at least two pixel units 100 of the column of pixel units 100 (i.e. 8 pixel units 100 corresponding to the first data line D1) reside are arranged according to the above arranged order for the pre-input data voltages Vdata.

In particular, the correspondence between the gate lines (G1, G2, . . . , G8) and the above pre-input data voltages Vdata (−1V, 0V, −3V, 3V, −2V, 2V, −3V, 1V) is shown in the following table 1.

TABLE 1

| Gate | D1 |
|---|---|
| G1 | −1 V |
| G2 | 0 V |
| G3 | −3 V |
| G4 | 3 V |
| G5 | −2 V |
| G6 | 2 V |
| G7 | −3 V |
| G8 | 1 V |

Therefore, the scanning order for gate lines on which at least two pixel units 100 of the column of pixel units 100 reside may be arranged according to the arranged order for the pre-input data voltages Vdata, that is −3V, −3V, −2V, −1V, 0V, 1V, 2V, 3V. For example, for 3 pixel units 100 in the column, the data voltages of which are respectively −3V, −3V, −2V, then the three gate lines (G3, G5, G7) on which these three pixel units 100 reside are scanned in the order of G3-G7-G5 (or G7-G3-G5). The scanning order for other gate lines may remain unchanged.

It is noted herein that, in the above scanning order, the signal difference between the pre-input data signals that are input to two pixel units 100 of the column of pixel units 100 (i.e. the eight pixel units 100 corresponding to the first data line D1) on two gate lines consecutively driven in the scanning order may be equal to a preset threshold, and when the preset threshold (e.g. the voltage-difference threshold) is 0, the method for determining the scanning order for the gate lines according to the pre-input data voltages Vdata may comprises:

the scanning order for the gate lines on which pixel units 100 with identical pre-input data signals (e.g. the pre-input data voltages Vdata) reside is the same as a wiring order for such gate lines.

In particular, the data voltages for the two pixel units 100 in the first column of pixel units 100 respectively corresponding to the gate lines G3 and G7 have the same value and polarity. In this circumstance, the voltage difference between these two pixel units on the gate lines G3 and G7 is 0V. Considering the wiring order, the gate line G3 is prior to the gate line G7. Therefore, the gate line G3 is also prior to the gate line G7 in the scanning order, and thus the control procedure may be simplified with the original scanning driving method.

As another example, in the arranged order for the pre-input data voltages, that is, −3V, −3V, −2V, −1V, 0V, 1V, 2V, 3V, the voltage difference between any two data voltages Vdata is less than or equal to 1V. Therefore, if the scanning order for all gate lines is arranged according to the above arranged order for the pre-input data voltages Vdata, the magnitude of reversal for the data voltages may be significantly reduced when inputting the data voltages by the data line. Specifically, the scanning order is show as the following table 2.

TABLE 2

| Scanning Order | Gate | D1 |
|---|---|---|
| 1 | G3 | −3 V |
| 2 | G7 | −3 V |
| 3 | G5 | −2 V |
| 4 | G1 | −1 V |
| 5 | G2 | 0 V |
| 6 | G8 | 1 V |
| 7 | G6 | 2 V |
| 8 | G4 | 3 V |

The following steps are the same as S103, S104.

It is noted that, firstly, while arranging the scanning order for the gate lines, the present embodiment is exemplified by eight pixel units 100 corresponding to the first data line D1. The present embodiment may also be exemplified by another data line, or another number of pixel units 100. These details, which are not limited by the present disclosure, should belong to the scope of the present disclosure.

Secondly, the present embodiment is exemplified by arranging the pre-input data voltages Vdata (−1V, 0V, −3V, 3V, −2V, 2V, −3V, 1V) in an ascending order. However, the present embodiment is also adapted to a descending order, which will not be repeated herein for conciseness.

Second Embodiment

Figure 4A:
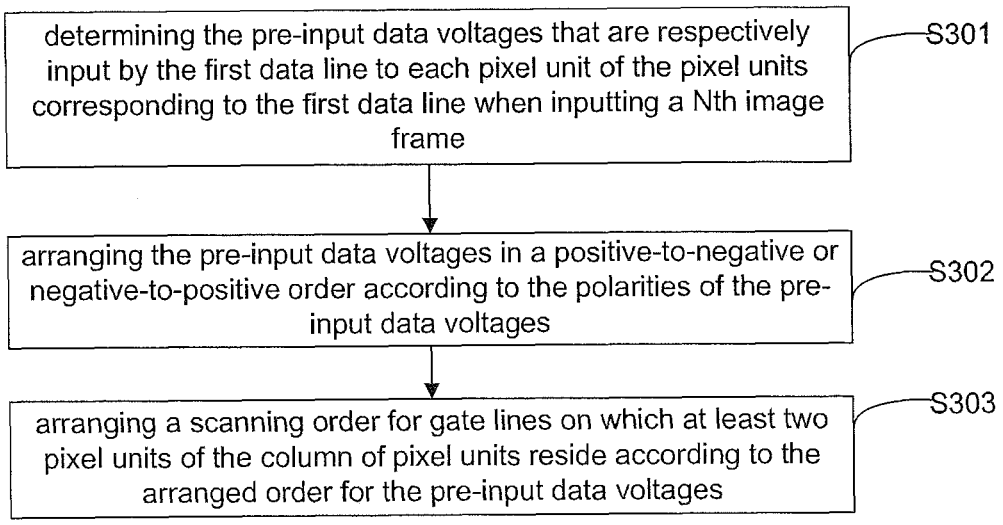
FIG. 4*a* is a flow chart of another display driving method according to an embodiment of the present disclosure.
Figure 4B:
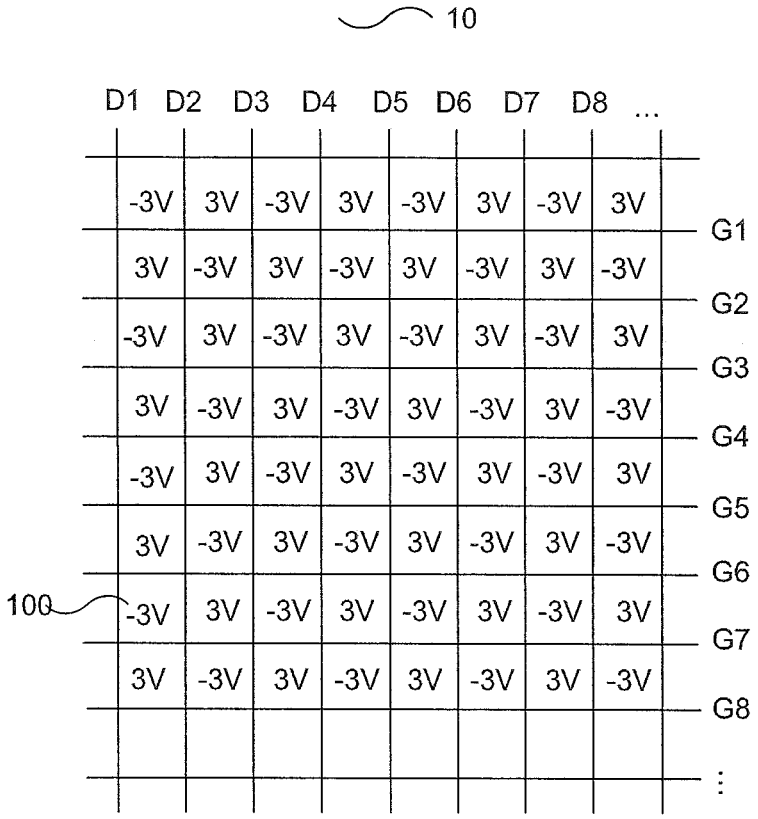
FIG. 4*b* is a diagram illustrating another data signal input for a display panel according to an embodiment of the present disclosure.

For a grayscale image, since the whole image presents only one grayscale, the grayscales for all pixel units 100 are the same. When the above pre-input data signals P_Dm are pre-input data voltages Vdata, for a display panel with a point reversal driving manner, the pre-input data voltages Vdata for all pixel units are the same, however, the polarity of the pre-input data voltage Vdata for each pixel unit is opposite to that for its adjacent pixel units. In this case, the method for determining a scanning order for gate lines (G1, G2, G3), as shown in FIG. 4*a*, may comprises:

At S301, the pre-input data voltages Vdata that are respectively input by the first data line D1 to each of the pixel units corresponding to the first data line D1 are determined when inputting a Nth image frame.

In particular, for a grayscale image, the grayscales for the pixel units 100 are the same, therefore the absolute values of the data voltages input to the pixel units 100 are also the same. As shown in FIG. 3*b*, the pre-input data voltages Vdata for the pixel units 100 corresponding to the first data line D1 are −3V, 3V, −3V, 3V, −3V, 3V, −3V, 3V respectively. From the these voltages, it can be seen that, while the gate lines (G1, G2, . . . , G8) are opened line by line, the pre-input data voltages Vdata will have to be greatly reversed for 7 times, especially the voltage is changed from −3V to 3V, and thereby increasing the power consumption for the display driver.

At S302, the pre-input data voltages Vdata are arranged in a positive-to-negative or negative-to-positive order according to the polarities of the pre-input data voltages Vdata.

The absolute values for the pre-input data voltages Vdata are equal, therefore the above pre-input data voltages Vdata (−3V, 3V, −3V, 3V, −3V, 3V, −3V, 3V) may be arranged in a negative-to-positive order according to the polarities, that is, −3V, −3V, −3V, −3V, 3V, 3V, 3V, 3V, wherein, the difference between two adjacent pre-input data voltages Vdata with the same polarity is 0V, which is less than the preset threshold 1V.

At S303, a scanning order for gate lines on which at least two pixel units 100 of the column of pixel units 100 (i.e. 8 pixel units 100 corresponding to the first data line D1) reside are arranged according to the arranged order for the pre-input data voltages Vdata.

In particular, the correspondence between the gate lines (G1, G2, . . . , G8) and the above pre-input data voltages Vdata (−3V, 3V, −3V, 3V, −3V, 3V, −3V, 3V) is shown in the following table 3.

TABLE 3

| Gate | D1 |
|---|---|
| G1 | −3 V |
| G2 | 3 V |
| G3 | −3 V |
| G4 | 3 V |
| G5 | −3 V |
| G6 | 3 V |
| G7 | −3 V |
| G8 | 3 V |

Therefore, the scanning order for gate lines on which at least two pixel units 100 of the column of pixel units 100 reside may be arranged according to the arranged order for the pre-input data voltages Vdata, that is −3V, −3V, −3V, −3V, 3V, 3V, 3V, 3V. For example, for 3 pixel units 100 in the column, the data voltages of which are −3V, −3V, −3V respectively, the three gate lines (G1, G3, G5) on which these three pixel units 100 reside are scanned in the order of G1-G3-G5. The scanning order for other gate lines may remain unchanged.

It is noted that, the data voltages Vdata for the pixel units 100 in the first column of pixel units 100 respectively corresponding to the gate lines G1, G3 and G5 have the same value of −3V. Considering the wiring order, the gate line G1 is prior to the gate line G3, and the gate line G3 is prior to the gate line G5. Therefore, the scanning order for the gate lines is the same as the wiring order. The control procedure may thus be simplified with the original scanning driving method.

As another example, in the arranged order for the pre-input data voltages, that is, −3V, −3V, −3V, −3V, 3V, 3V, 3V, 3V, the voltage difference between any two data voltages Vdata with the same polarity is equal to 0V. Therefore, if the scanning order for all gate lines are arranged according to the above arranged order for the pre-input data voltages Vdata, then while inputting the data voltages by the data line, the magnitude of reversal for the data voltages may be significantly reduced. Specifically, the scanning order is show as the following table 4.

TABLE 4

| Scanning Order | Gate | D1 |
|---|---|---|
| 1 | G1 | −3 V |
| 2 | G3 | −3 V |
| 3 | G5 | −3 V |
| 4 | G7 | −3 V |
| 5 | G2 | 3 V |
| 6 | G4 | 3 V |
| 7 | G6 | 3 V |
| 8 | G8 | 3 V |

The following steps are the same as S103, S104.

It is noted that, firstly, while arranging the scanning order for the gate lines, the present embodiment is exemplified by eight pixel units 100 corresponding to the first data line D1. The present embodiment may also be exemplified by another data line, or another number of pixel units 100. These details, which are not limited by the present disclosure, should belong to the scope of the present disclosure.

Secondly, the present embodiment is exemplified by arranging the pre-input data voltages Vdata (−3V, 3V, −3V, 3V, −3V, 3V, −3V, 3V) in a negative-to-positive order. However, the present embodiment is also adapted to a positive-to-negative order, which will not be repeated herein for conciseness.

Third Embodiment

Figure 5A:
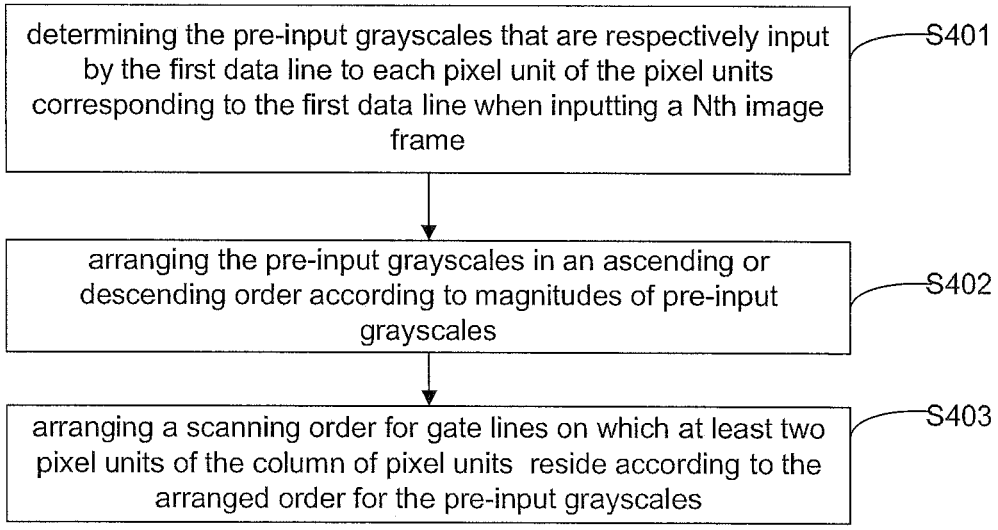
FIG. 5*a* is a flow chart of another display driving method according to an embodiment of the present disclosure.
Figure 5B:
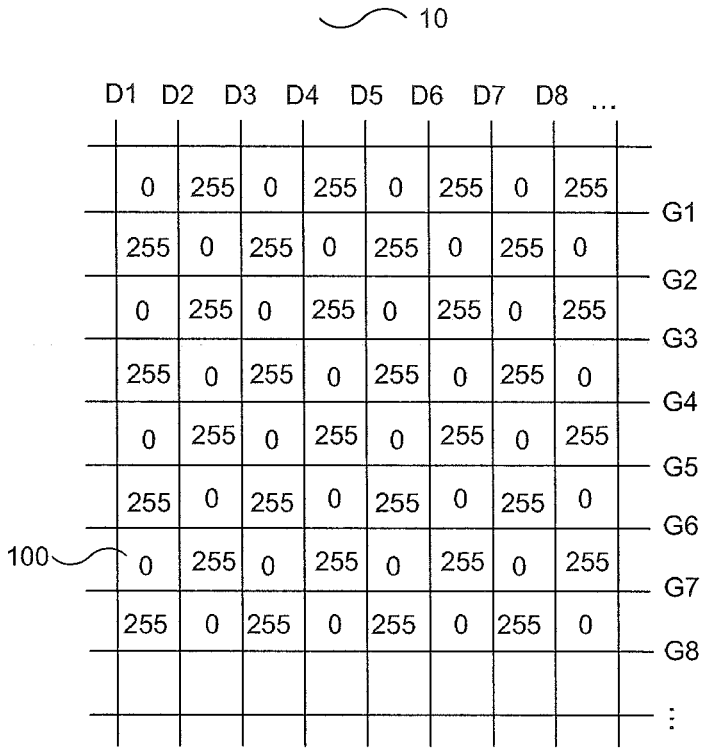
FIG. 5*b* is a diagram illustrating another data signal input for a display panel according to an embodiment of the present disclosure.
Figure 6:
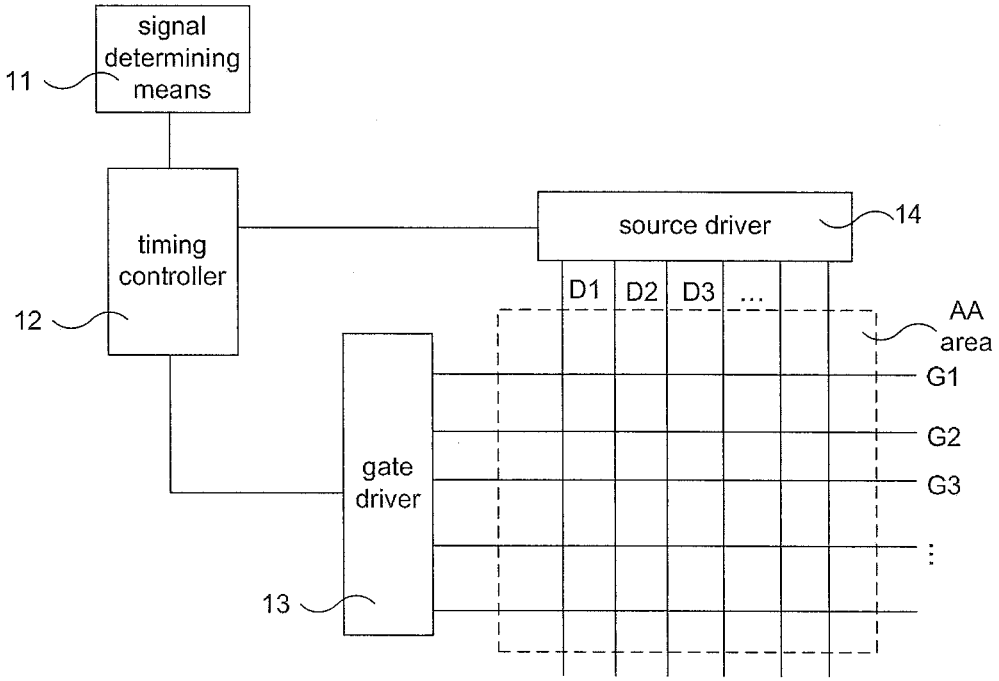
FIG. 6 is a structural diagram of a display driving circuit according to an embodiment of the present disclosure.

When the above pre-input data signals P_Dm are pre-input grayscales (0-255), the magnitudes of the pre-input data signals P_Dm may be values of the pre-input grayscales (0~255). Additionally, the preset threshold may be the grayscale-difference threshold. On the condition that the grayscale-difference threshold equals to 10, the method for determining a scanning order for gate lines (G1, G2, G3 . . . ) according to the pre-input grayscales (0~255), as shown in FIG. 5*b*, may comprises:

At S401, the pre-input grayscales (0~255) that are respectively input by the first data line D1 to each of the pixel units corresponding to the first data line D1 are determined when inputting a Nth image frame.

In particular, taking a black-white chess board pattern for example, pixel units 100 with a grayscale of 0 and pixel units 100 with a grayscale of 255 are alternately placed. As shown in FIG. 5*b*, the pre-input grayscales (0~255) for the pixel units 100 corresponding to the first data line D1 are 0, 255, 0, 255, 0, 255, 0, 255 respectively (data voltages for other columns are not shown). From the these pre-input grayscales (0~255), it can be seen that, while the gate lines (G1, G2, . . . , G8) are opened line by line, the pre-input grayscales (0~255) will have to be greatly reversed for 7 times, wherein grayscale 0 is the minimum of the 256 grayscales, and grayscale 255 is the maximum of the 256 grayscales. Therefore, the difference between the data voltages corresponding to the grayscale 0 and the grayscale 255 is very large, which means the data voltage needs to be changed a lot when turning from grayscale 0 to grayscale 255, and thus the power consumption for the display driver is increased.

At S402, the pre-input grayscales are arranged in an ascending or descending order according to magnitudes of pre-input grayscales (0~255).

For example, the above pre-input grayscales (0, 255, 0, 255, 0, 255, 0, 255) are arranged in an ascending order according to the magnitudes of the pre-input grayscales, that is, 0, 0, 0, 0, 255, 255, 255, 255, wherein, in the first (or last) 4 grayscales, the difference between any two adjacent grayscales is 0, which is less than 10.

At S403, a scanning order for gate lines on which at least two pixel units 100 of the column of pixel units 100 (i.e. 8 pixel units 100 corresponding to the first data line D1) reside are arranged according to the arranged order for the pre-input grayscales.

In particular, the correspondence between the gate lines (G1, G2, . . . , G8) and the above pre-input grayscales (0, 255, 0, 255, 0, 255, 0, 255) is shown in the following table 5.

TABLE 5

| Gate | D1 |
|---|---|
| G1 | 0 |
| G2 | 255 |
| G3 | 0 |
| G4 | 255 |
| G5 | 0 |
| G6 | 255 |
| G7 | 0 |
| G8 | 255 |

Therefore, the scanning order for gate lines on which at least two pixel units 100 of the column of pixel units 100 reside may be arranged according to the arranged order for the pre-input grayscales, that is 0, 0, 0, 0, 255, 255, 255, 255. For example, for 3 pixel units 100 in the column, the data voltages of which are 0, 0, 0 respectively, then the three gate lines (G1, G3, G5) on which these three pixel units 100 reside are scanned in the order of G1-G3-G5. The scanning order for other gate lines may remain unchanged.

It is noted that, the pre-input grayscales for the pixel units 100 in the first column of pixel units 100 respectively corresponding to the gate lines G1, G3 and G5 have the same value of 0. Considering the wiring order, the gate line G1 is prior to the gate line G3, and the gate line G3 is prior to the gate line G5. Therefore, the scanning order for the gate lines is the same as the wiring order. The control procedure may thus be simplified with the original scanning driving method.

As another example, in the arranged order for the pre-input grayscale, that is, 0, 0, 0, 0, 255, 255, 255, 255, the grayscale difference between two pre-input grayscales with the same value is equal to 0. Therefore, if the scanning order for all gate lines are arranged according to the above arranged order for the pre-input grayscales, then while inputting the grayscales by the data line, the level of reversing for the data voltages corresponding to the grayscales may be significantly reduced. Specifically, the scanning order is show as the following table 6.

TABLE 6

| Scanning Order | Gate | D1 |
|---|---|---|
| 1 | G1 | 0 |
| 2 | G3 | 0 |
| 3 | G5 | 0 |
| 4 | G7 | 0 |
| 5 | G2 | 255 |
| 6 | G4 | 255 |
| 7 | G6 | 255 |
| 8 | G8 | 255 |

The following steps are the same as S103, S104.

It is noted that, firstly, while arranging the scanning order for the gate lines, the present embodiment is exemplified by eight pixel units 100 corresponding to the first data line D1. The present embodiment may also be exemplified by another data line, or another number of pixel units 100. These details, which are not limited by the present disclosure, should belong to the scope of the present disclosure.

Secondly, the present embodiment is exemplified by arranging the pre-input grayscales in an ascending order of 0, 0, 0, 0, 255, 255, 255, 255. However, the present embodiment is also adapted to a descending order, which will not be repeated herein for conciseness.

Thirdly, although the present embodiment is illustrated according to a black-white chess board pattern, it is adapted to a color pattern, wherein the principles of the driving method for them are the same, which will not be repeated herein.

The embodiments of the present disclosure provide a display driving circuit for driving a display panel (as shown in FIG. 2*a*, a display panel 10) for displaying, wherein the display panel comprises an array of pixel units 100 formed by crossing a plurality of rows of gate lines (G1, G2, G3 . . . ) and a plurality of columns of data lines (D1, D2, D3 . . . ), the display driving circuit comprises: a signal determining means 11, a timing controller 12, a gate line driver 13 and a source driver 14.

The signal determining means 11, which is connected to the timing controller 12, is configured to determine pre-input data signals P_Dm that are respectively input by a data line (D1) to each pixel unit of a column of pixel units (11*a*, 11*b*, 11*c* . . . ) corresponding to the data line when inputting a Nth image frame, wherein N≥1;

The timing controller 12, which is connected to the gate line driver 13 and the source driver 14, is configured to determine, according to magnitudes or polarities of the pre-input data signals P_Dm, a scanning order for at least two gate lines, such that a signal difference between the pre-input data signals P_Dm that are input to two pixel units 100 of the column of pixel units on two gate lines consecutively driven in the scanning order is less than or equal to a preset threshold;

The gate driver 13, which is connected to the timing controller 12 and the gate lines (G1, G2, G3 . . . ) respectively, is configured to scan the gate lines according to the scanning order, so as to open each row of pixel units 100 according to the scanning order; and The source driver 14, which is connected to the timing controller 12 and the data lines (D1, D2, D3 . . . ) respectively, is configured to input the pre-input data signals P_Dm to corresponding pixel units 100 by the data lines (D1, D2, D3 . . . ) to achieve an image display.

It is noted that, the display panel 10 may be divided into an active area (AA areas) and a non-displaying area, wherein the array of pixel units 100 formed by crossing the gate lines and the data lines are located in the above AA area, and the signal determining means 11, the timing controller 12, the gate line driver 13 and the source driver 14 for driving the display panel for displaying are located in the non-displaying area. The signal determining means 11 may be integrated into the timing controller 12 for achieving a narrow-bezel design with a small non-displaying area.

The present disclosure provides a display driving circuit for driving the display panel for displaying. The display panel comprises an array of pixel units formed by crossing a plurality of rows of gate lines and a plurality of columns of data lines. The display driving circuit comprises: a signal determining apparatus, a timing controller, a gate driver and a source driver. The signal determining apparatus is configured to determine pre-input data signals that are respectively input by a data line to each pixel unit of a column of pixel units corresponding to the data line when inputting a Nth image frame, such that variations of the pre-input data signals provided by a data line during input of a frame of a display image is obtained; the timing controller is configured to determine, according to magnitudes or polarities of the pre-input data signals, a scanning order for the gate lines, such that a signal difference between the pre-input data signals that are input to two pixel units of the column of pixel units on two gate lines consecutively driven in the scanning order is less than or equal to a preset threshold; the gate driver is configured to scan the gate lines according to the above scanning order, so as to open each row of pixel units according to the scanning order; and the source driver is configured to input the pre-input data signals to corresponding pixel units by the data lines to achieve an image display. Differences between data signals for two pixel units of a same column of pixel units on two gate lines consecutively driven in the scanning order may be reduced by changing the scanning order for the gate lines, and thus prevent the data signals (e.g. data voltages) input by the data lines from being greatly reversed. Therefore, the above driving method may reduce power consumption for the display driver and improve the display's performance.

The present disclosure provides a display apparatus, comprising the display driving circuit as above. The display apparatus has the same structure and benefits as the above display driving circuit. Such structure and benefits will not be repeated herein since they have already been described in the above embodiments, It is noted that, in the embodiments of the present disclosure, the display apparatus may be one of a liquid crystal display apparatus and an OLED display apparatus, for example, the display apparatus may be a liquid crystal display, a liquid crystal TV, a digital photo frame, a cell phone or a tablet computer or any other product or part with a display function.

Those skilled in the art should understand that: all or part of the steps for implementing the above method embodiments may be realized with hardware related to program instructions, whereas the program may be stored in a computer-readable storage medium, and when the program is being executed, steps for the above method embodiments are performed; the storage medium may be: ROM, RAM, a magnetic disc, an optical disk or any other mediums that are capable of storing program codes.

Although the present disclosure is described as the above embodiments, the scope of the present disclosure is not limited to them. Various variations or substitutions that may be easily envisaged by those skilled in the art also belong to the scope which is defined by the claims.

What is claimed is:

1. A driving method for a display driving circuit, wherein the method is used for driving a display panel for displaying, and the display panel comprises an array of pixel units formed by crossing a plurality of rows of gate lines and a plurality of columns of data lines, the method comprising:

determining pre-input data signals that are respectively input by a data line to each pixel unit of a column of pixel units corresponding to the data line when inputting a Nth image frame, wherein N≥1;

determining, according to magnitudes or polarities of the pre-input data signals, a scanning order for the gate lines, such that an absolute value of a signal difference between the pre-input data signals that are input to two pixel units of the column of pixel units on two gate lines consecutively driven in the scanning order is greater than or equal to zero and less than or equal to a preset threshold;

scanning the gate lines according to the scanning order, so as to open each row of pixel units according to the scanning order; and inputting the pre-input data signals to corresponding pixel units by the data lines to achieve an image display, wherein the pre-input data signals comprise pre-input data voltages.

2. The driving method of claim 1, wherein the pre-input data signals further comprises: pre-input grayscales.

3. The driving method of claim 1, wherein when the pre-input data signals are the pre-input data voltages, the preset threshold is a voltage-difference threshold, which equals to 1V.

4. The driving method of claim 3, wherein the step of determining, according to magnitudes or polarities of the pre-input data signals, a scanning order for the gate lines comprises:

arranging the pre-input data voltages in an ascending or descending order according to values and polarities of the pre-input data voltages;

arranging a scanning order for gate lines on which at least two pixel units of the column of pixel units reside according to the arranged order for the pre-input data voltages.

5. The driving method of claim 3, wherein the step of determining, according to magnitudes or polarities of the pre-input data signals, a scanning order for the gate lines comprises:

arranging the pre-input data voltages in a negative-to-positive or positive-to-negative order according to polarities of the pre-input data voltages;

arranging a scanning order for gate lines on which at least two pixel units of the column of pixel units reside according to the arranged order for the pre-input data voltages.

6. The driving method of claim 2, wherein when the pre-input data signals are the pre-input grayscales, the preset threshold is a grayscale-difference threshold, which equals to 10.

7. The driving method of claim 6, wherein the step of determining, according to magnitudes or polarities of the pre-input data signals, a scanning order for the gate lines comprises:

arranging the pre-input grayscales in an ascending or descending order according to magnitudes of the pre-input grayscales;

arranging a scanning order for gate lines on which at least two pixel units of the column of pixel units reside according to the arranged order for the pre-input grayscales.

8. The driving method of claim 5, wherein the polarities of the pre-input data voltages for pixel units in a same row are identical; and the polarities of the pre-input data voltages for pixel units in adjacent rows are opposite.

9. The driving method of claim 5, wherein the polarity of the pre-input data voltage for each pixel unit is opposite to that for its adjacent pixel units.

10. The driving method of claim 1, wherein when a signal difference between the pre-input data signals that are input to two pixel units of the column of pixel units on two gate lines consecutively driven in the scanning order is equal to a preset threshold and the preset threshold is zero, the step of determining, according to magnitudes or polarities of the pre-input data signals, a scanning order for the gate lines comprises:

the scanning order for the gate lines on which pixel units with identical pre-input data signals reside is the same as a wiring order for such gate lines.

11. A display driving circuit for driving a display panel for displaying, wherein the display panel comprises an array of pixel units formed by crossing a plurality of rows of gate lines and a plurality of columns of data lines, the display driving circuit comprising:

a signal determining means for determining pre-input data signals that are respectively input by a data line to each pixel unit of a column of pixel units corresponding to the data line when inputting a Nth image frame, wherein N≥1;

a timing controller, which is connected to the signal determining means, for determining, according to magnitudes or polarities of the pre-input data signals, a scanning order for the gate lines, such that an absolute value of a signal difference between the pre-input data signals that are input to two pixel units of the column of pixel units on two gate lines consecutively driven in the scanning order is greater than or equal to zero and less than or equal to a preset threshold;

a gate driver, which is connected to the timing controller and the gate lines respectively, for scanning the gate lines according to the scanning order, so as to open each row of pixel units according to the scanning order; and a source driver, which is connected to the timing controller and the data lines respectively, for inputting the pre-input data signals to corresponding pixel units by the data lines to achieve an image display, wherein the pre-input data signals comprise pre-input data voltages.

12. A display apparatus, comprising the display driving circuit in claim 11.

* * * * *